United States Patent [19]

Upadek et al.

[11] Patent Number: 4,846,990

[45] Date of Patent: Jul. 11, 1989

[54] FABRIC-SOFTENING DETERGENT

[75] Inventors: Horst Upadek, Ratingen; Winfried Wichelhaus, Mettmann, both of Fed. Rep. of Germany

[73] Assignee: Henkel Kommanditgesellschaft auf Aktien, Duesseldorf, Fed. Rep. of Germany

[21] Appl. No.: 146,871

[22] Filed: Jan. 22, 1988

[30] Foreign Application Priority Data

Jan. 24, 1987 [DE] Fed. Rep. of Germany ..... 3702068

[51] Int. Cl.[4] ..... D06M 13/00

[52] U.S. Cl. ..... 252/8.8; 252/98; 252/99; 252/525; 252/544; 252/547; 252/DIG. 15

[58] Field of Search ..... 252/8.8, 8.75, 110, 252/132, 133, 134, 540, 525, 99, 544, 547

[56] References Cited

U.S. PATENT DOCUMENTS

| | | | |
|---|---|---|---|
| B14,062,647 | 2/1985 | Storm et al. | 8/137 |
| 3,966,629 | 6/1976 | Dumbrell | 252/140 |
| 4,062,647 | 12/1977 | Storm et al. | 8/137 |
| 4,083,793 | 4/1978 | Jakobi et al. | 252/99 |
| 4,148,603 | 4/1979 | Schwuger et al. | 8/137 |
| 4,375,416 | 3/1983 | Crisp et al. | 252/8.75 |
| 4,737,306 | 4/1988 | Wichelhaus et al. | 252/99 |

FOREIGN PATENT DOCUMENTS

| | | |
|---|---|---|
| 11340 | 5/1980 | European Pat. Off. . |
| 0109717 | 6/1986 | European Pat. Off. . |
| 109717 | 6/1986 | European Pat. Off. . |

*Primary Examiner*—A. Lionel Clingman
*Assistant Examiner*—John F. McNally
*Attorney, Agent, or Firm*—Ernest G. Szoke; Wayne C. Jaeschke; Real J. Grandmaison

[57] ABSTRACT

A detergent composition containing a surfactant, builder, and a fabric softener component comprising one or more tertiary amines containing at least one long-chain alkyl or alkenyl group and a synthetic layer silicate having a smectite-like crystal phase and, compared with natural smectites, a reduced swelling power in water. The detergent composition provides good fabric softening effect and a good detergent effect.

20 Claims, No Drawings

FABRIC-SOFTENING DETERGENT

BACKGROUND OF THE INVENTION

1. Field of the Invention:

This invention relates to a detergent composition containing a surfactant, a builder, a fabric softener component comprising a tertiary amine, and a layer silicate.

2. Discussion of Related Art:

Numerous proposals have been put forward with a view to incorporating in fabric detergents a softening component which fabrics take up during the washing process and, in doing so, are given a better, softer feel. The cationic compounds most commonly used to soften fabrics in the rinse cycle of a wash program cannot be used in detergents containing typical anionic surfactants because the cationic softeners react with the anionic surfactants to form ineffective compounds. Accordinly, there has been no shortage of attempts to replace the cationic softeners by nonionic softeners which do not react with anionic surfactants. However, nonionic softeners generally do not have the effectiveness of known cationic softeners. Clay-like layer silicates of the smectite type are described as a fabric softening component for detergent compositions containing anionic surfactants in U.S. Pat. Nos. 3,966,629 and 4,062,647. However, detergents containing clay-like materials have tendentially poorer detergency levels. According to the teaching of European patent specification 11 340, this disadvantage is obviated by using a combination of a certain class of tertiary amines and smectites as a softening component. Earlier-filled European patent application 86/109 717.8 describes smectite-like synthetic layer silicates which have an incrustation-inhibiting effect in standard detergent compositions. These smectite-like synthetic layer silicates do not have a pronounced softening power.

DESCRIPTION OF THE INVENTION

Other than in the operating examples, or where otherwise indicated, all numbers expressing quantities of ingredients or reaction conditions used herein are to be understood as modified in all instances by the term "about".

It has now surprisingly been found that a detergent composition containing a surfactant, a builder, a fabric softener component comprising a tertiary amine, and a layer silicate show particularly valuable properties. Accordingly, the present invention relates to a fabric-softening detergent composition containing a surfactant, a builder, and a fabric softener component comprising (a) a tertiary amine corresponding to the following formula $$R^1R^2R^3N \qquad (I)$$

wherein $R^1$ is a $C_{10}$–$C_{24}$ alkyl or alkenyl group, $R^2$ is the same as $R^1$ or a $C_1$–$C_4$ alkyl group, $R^3$ is a $C_1$–$C_4$ alkyl group, or a mixture of these amines, and (b) a layer silicate. The layer silicate is a fabric incrustation-inhibiting synthetic layer silicate having a smectite-like crystal phase and corresponding to the following oxide summation formula $$MgO.a\ M_2O.b\ Al_2O_3.c\ SiO_2.n\ H_2O \qquad (II)$$

wherein

M represents sodium, optionally sodium together with lithium, with the proviso that the molar ratio of Na to Li is at least 2, and wherein a is equal to 0.05 to 0.4, b is equal to 0 to 0.3, c is equal to 1.2 to 2.0 and n is equal to 0.3 to 3.0, n representing the water bound in the crystal phase. This synthetic layer silicate is described in earlier-filled European patent application No. 86/109 717.8.

Earlier-filed European patent application 86/109 717.8 describes layer silicates having a smectite-like crystal structure, but in comparative terms, a distinctly reduced swelling power in water. These layer silicates are synthetic, finely-divided, water-insoluble layer silicates which have a smectite-like crystal phase, but have an increased content of bound alkali and silicate, and compared with pure layer silicates of this type, a distinctly reduced swelling power in aqueous suspension and which have the following oxide summation formula $$MgO.a\ M_2O.b\ Al_2O_3.c\ SiO_2.n\ H_2O$$

wherein M represents sodium or a mixture of sodium and lithium, with the proviso that the molar ratio of sodium to lithium is at least 2, and wherein the parameters a,b,c, and n each represent a number within the following ranges:

a is equal to 0.05 to 0.4, b is equal to 0 to 0.3, c is equal to 1.2 to 2.0, and n is equal to 0.3 to 3.0. In this oxide summation formula, the water content n $H_2O$ stands for the water bound in the crystal phase. These very finely-divided clay minerals may be regarded as layer silicates having structural features of mica-like layer silicates, albeit with a dislocation in regard to the linkage of adjacent layers. A structural formula of the type usually expressed in idealized form for clay minerals can only be drawn up under additional hypotheses for the layer silicates according to the invention. However, the chemical composition of the new compounds shows more $Na_2O$ and $SiO_2$ than the associated saponite and hectorite smectities. It may be assumed that, in addition to the layer arrangement typical of mica-like compounds of this type, these layer silicates contain units of incorporated sodium silicates. From the viewpoint of structure and synthesis the crystallization of the layer silicates may presumably be interpreted as mixed crystal formation in which sodium silicate is incorporated in smectite. The X-ray diffractograms show that this incorporation is not regular, but instead leads to dislocations in the crystallites. Accordingly, crystallographic characterization by lattice constants which describe an elementary cell is not possible. On the basis of the chemical composition selected, synthetic smectites as defined above include saponite- and hectorite-like phases. The mixed crystal system should therefore be described by the following structural formula $$[Na_{x+y}(Mg_{3-x}Li_x)\ (Si_{4-y}Al_y)O_{10}(OH)_2].m\ [Na_2Si_zO_{2z+1}].n\ H_2O$$

the first part of the formula characterizing the smectite and the second part the sodium polysilicate. Both components form one phase in which the smectite determines the structure.

The variables may assume the following numerical values:

x is equal to 0 to 0.3, preferably 0 to 0.1;

y is equal to 0 to 0.5, preferably 0 to 0.4;

x+y is equal to 0.1 to 0.5, preferably 0.2 to 0.4;
z is equal to 1 to 22, preferably 1 to 14;
m is equal to 0.1 to 0.5, preferably 0.1 to 0.3; and
n is equal to 0 to 8, preferably 2 to 6.

The composition of the synthetic layer silicates according to the invention which differs distinctly from the pure smectites and the associated dislocation in the crystal structure leads to changes in a number of properties typical of layer silicates per se, particularly in regard to their swellability and hence their gel-forming properties and also in their exchange capacity.

The surfactants in the context of this invention may contain at least one hydrophobic organic radical and a water-solubilizing anionic, zwitter-ionic or nonionic group in the molecule. The hydrophobic radical is generally in aliphatic hydrocarbon radical containing from 8 to 26, preferably from 10 to 22, and more preferably from 12 to 18 carbon atoms, or an alkyl aromatic radical containing from 6 to 18 and preferably from 8 to 16 aliphatic carbon atoms.

Suitable anionic surfactants include, for example, soaps of natural or synthetic, preferably saturated, fatty acids or even of resinic or naphthenic acids. Suitable synthetic anionic surfactants include those of the sulfonate, sulfate and synthetic carboxylate type.

Suitable sufactants of the sulfonate type include alkyl benzenesulfonates ($C_9$ to $C_{15}$ alkyl), olefin sulfonates, i.e. mixtures of a alkane and hydroxyalkane sulfonates and also disulfonates of the type obtained, for example, from $C_{12}$–$C_{18}$ monoolefins containing a terminal or internal double bond by sulfonation with gaseous sulfur trioxide and subsequent alkaline or acidic hydrolysis of the sulfonation products. Also suitable are the alkane sulfonates obtainable from $C_{12}$–$C_{18}$ alkanes by sulfochlorination or sulfoxidation and subsequent hydrolysis or neutralization or by bisulfite addition to olefins and esters of $\alpha$-sulfofatty acids, for example $\alpha$-sulfonated methyl or ethyl esters of hydrogenated coconut oil, palm kernel oil or tallow fatty acids.

Suitable surfactants of the sulfate type include the sulfuric acid monoesters of primary alcohols of natural and synthetic origin, i.e. of fatty alcohols such as, for example, coconut oil fatty alcohols, tallow fatty alcohols, oleyl alcohol, lauryl, myristyl, palmityl of stearyl alcohol, or the $C_{10}$–$C_{20}$ oxoalcohols and secondary alcohols of the same length. Sulfuric acid monoesters of aliphatic primary alcohols ethoxylated with from 1 to 6 moles ethylene oxide, oxide ethoxylated secondary alcohols and alkylphenols are also suitable. Sulfated fatty acid alcohol amides and sulfated fatty acid monoglycerides are also suitable.

Other suitable anionic surfactants include the fatty acid esters and amides of hydroxyl- or aminocarboxylic acids and sulfonic acids, such as for example fatty acid sarcosides, glycolates, lactates, taurides or isethionates.

The anionic surfactants may be present in the form of their sodium, potassium and ammonium salts and also as soluble salts of organic bases, such as mono-, di- or tri-ethanolamine.

Suitable nonionic surfactants include adducts of from 1 to 40 and preferably from 2 to 20 moles ethylene oxide with 1 mole of a compound containing 10 to 20 carbon atoms selected from the group consisting of an alcohol, alkylphenol, fatty acids, fatty amines, fatty acid amides or alkane sulfonamide. Of particular importance are the adducts of from 8 to 80 moles ethylene oxide with a primary alcohol, such as for example coconut oil or tallow fatty alcohols, with oleyl alcohol, with oxoalcohols or with secondary alcohols containing from 8 to 18 and preferably from 12 to 18 carbon atoms and with mono- or dialkylphenols containing from 6 to 14 carbon atoms in the alkyl radicals. In addition to these water-soluble nonionics, however, water-insoluble or substantially water-insoluble polyglycol ethers containing from 2 to 7 ethylene glycol ether groups in the molecule are also of interest, particularly if they are used together with water-soluble nonionic or anionic sufactants.

Other suitable nonionic surfactants include the water-soluble adducts, containing from 20 to 250 ethylene glycol ether groups and from 10 to 100 propylene glycol ether groups, of ethylene oxide with polypropylene glycol, alkylenediamine polypropylene glycol and with alkyl polypropylene glycol containing from 1 to 10 carbon atoms in the alkyl chain, in which the polypropylene glycol chain functions as the hydrophobic component. It is also possible to use nonionic surfactants of the amine oxide or sulfoxide type, for example the compounds N-cocosalkyl-N,N-dimethylamine oxide, N-hexadecyl-N,N-bis-(2,3-dihydroxypropyl)-amine oxide, and N-tallow alkyl-N,N-dihydroxyethylamine oxide.

The zwitter-ionic surfactants are preferably derivatives of aliphatic quaternary ammonium compounds, in which one of the aliphatic radicals consists of a $C_8$–$C_{18}$ radical, while another contains an anionic, water-solubilizing carboxy, sulfo or sulfato group. Typical representative of surface-active betaines such as these include, for example, the compounds 3-(N-hexadecyl-N,N-dimethylammonio)-propane sulfonate; 3-(N-tallow alkyl-N,N-dimethylammonio)-2-hydroxypropane sulfonate; 3-(N-hexadecyl-N,N-bis-(2-hydroxyethyl)-ammonio)-2-hydroxypropyl sulfate; 3-(N-cocosalkyl-N,N-bis-(2,3-dihydroxypropyl)-ammonio)-propane sulfonate; N-tetradecyl-N,N-dimethylammonioacetate; and N-hexadecyl-N,N-bis-(2,3-dihydroxypropyl)-ammonioacetate.

The foaming power of the surfactants may be increased or reduced by combining suitable surfactant types; a foaming reduction may also be obtained by the addition of non-surfactant-like organic compounds. Reduced foaming power, which is desirable where the detergents or cleaning preparations are used in a machine, may often be obtained by combining surfactants of various types, for example sulfates and/or sulfonates with nonionic surfactants and/or soaps. In the case of soaps, foam inhibition increases with the degree of saturation and the number of carbon atoms in the fatty acid component. Accordingly, soaps of saturated $C_{20}$–$C_{24}$ fatty acids are particularly suitable as foam inhibitors.

The non-surfactant-like foam inhibitors are generally water-insoluble compounds mostly containing aliphatic $C_8$–$C_{22}$ hydrocarbon radicals. Suitable non-surfactant-like foam inhibitors include, for example, N-alkylaminotriazines, i.e. reaction products of 1 mole cyanuric chloride with 2 to 3 moles of a mono-or dialkylamine essentially containing from 8 to 18 carbon atoms in the alkyl radical. Other suitable non-surfactant-like foam inhibitors include propoxylated and/or butoxylated aminotriazines, for example the reaction products of 1 mole melamine with from 5 to 10 moles propylene oxide and, in addition, from 10 to 50 moles butylene oxide, and also aliphatic $C_{18}$–$C_{40}$ ketones such as, for example, stearone, fatty ketones of hardened train oil fatty acid or tallow fatty acid, paraffins and halogen paraffins melting below 100° C. and silicone oil emulsions based on polymeric organosilicon compounds.

Suitable builders include, typically, organic and inorganic salts, particularly alkali metal salts, showing a mildly acidic, neutral or alkaline reaction which are capable of precipitating or complexing calcium ions. Of the inorganic salts, the water-soluble alkali metal metaphosphates or alkali metal polyphosphates, particularly pentasodium triphosphate, are of particular importance along with alkali metal orthophosphates and alkali metal pyrophosphates. These phosphates may be completely or partly replaced by organic complexing agents for calcium ions, including compounds of the aminopolycarboxylic acid type, such as for example nitrilotriacetic acid (NTA), ethylenediamine tetraacetic acid (EDTA), diethylenetriamine penta-acetic acid and higher homologs. Suitable phosphorus-containing organic complexing agents include the water-soluble salts of alkane polyphosphonic acids, amino- and hydroxyalkane polyphosphonic acids and phosphonopolycarboxylic acids such as, for example, methane disphosphonic acid, dimethylaminomethane-1,1-diphosphonic acid, aminotrimethylene triphosphonic acid, 1-hydroxyethane-1,1-diphosphonic acid, 1-phosphonoethane-1,2-dicarboxylic acids, and 2-phosphonobutane-1,2,4-tricarboxylic acid.

Among the organic builders, nitrogen- and phosphorus-free polycarboxylic acids which form complex salts with calcium ions, including polymers containing carboxyl groups, are of particular significance. Suitable organic builders of this type include, for example, citric acid, tartaric acid, benzenehexacarboxylic acid and tetrahydrofuran tetracarboxylic acid. Also suitable are polycarboxylic acids containing ether groups, such as 2,2'-oxydisuccinic acid and poly-functional alcohols or hydroxycarboxylic acids completely or partly etherified with glycolic acid, for example biscarboxymethyl ethylene glycol, carboxymethyloxysuccinic acid, carboxymethyl tartronic acid and carboxymethylated or oxidized polysaccharides. Polymeric carboxylic acids having a molecular weight of from 350 to 1,500,000 in the form of water-soluble salts are also suitable. Particularly preferred polymeric polycarboxylates have a moleculare weight of from 500 to 175,000 and more especially in the range from 10,000 to 100,000. These compounds include, for example, polyacrylic acid, poly-α-hydroxyacrylic acid, polymaleic acid and also copolymers of the corresponding monomeric carboxylic acids with one another or with ethylenically unsaturated compounds, such as vinylmethyl ether. Water-soluble salts of polyglyoxylic acid are also suitable. Suitable water-insoluble inorganic builders include the finely-divided, synthetic sodium aluminosilicates of the zeolite A type containing bound water as described in U.S. Pat. Nos. 4,083,793 and 4,148,603 as phosphate substitutes for detergents and cleaning preparations.

The cation-exchanging sodium aluminosilicates are used in their usual hydrated, finel crystalline form, i.e. they contain virtually no particles larger than 30 microns and preferably consist of at least 80% of particles smaller than 10 microns in size. Their calcium binding power as determined in accordance with German patent application No. 24 12 837 is in the range from 100 to 200 mg CaO/g. Zeolite NaA is particularly suitable as are zeolite NaX and mixtures of NaA and NaX.

Suitable inorganic, non-complexing salts include the alkali metal salts, also known as "washing alkalis", of bicarbonates, carbonates, borates, sulfates and silicates. Of the alkali metal silicates, sodium silicates in which the ratio of $Na_2O$ to $SiO_2$ is from 1:1 to 1:3.5 are particularly preferred.

Other builders which are generally used in liquid preparations by virtue of their hydrotropic properties include the salts of non-capillary-active $C_2$–$C_9$ sulfonic acids, carboxylic acids and sulfocarboxylic acids, for example the alkali metal salts of alkane, benzene, toluene, xylene or cumene sulfonic acids, sulfobenzoic acids, sulfophthalic acid, sulfoacetic acids, sulfosuccinic acid and the salts of acetic acid or lactic acid. Acetamide and urea are also suitable solubilizers.

Suitable amines of formula I include those in which $R^1$ and $R^2$ independently of one another are $C_{12}$–$C_{22}$ groups, preferably linear alkyl groups, and $R^3$ is preferably methyl or ethyl. Suitable amines include, for example, didecyl methylamine, dilauryl methylamine, dimyristyl methylamine, dicetyl methylamine, distearyl methylamine, diarachidyl methylamine, dibehenyl methylamine, ditallowalkyl methylamine, tallowalkyl dimethylamine and the corresponding ethylamines, propylamines and butylamines. Ditallowalkyl methylamine is particularly preferred.

The detergent composition according to this invention contains the tertiary amine and the layer silicate in a ratio by weight of from 3:1 to 1:3. Particularly suitable layer silicates having the afore-mentioned oxide summation formula II are those in which a is equal to 0.15 to 0.30, b is equal to 0 to 0.10 and c is equal to 1.3 to 1.5. The ratio of a to b is preferably equal to or greater than 3. The fabric softener component comprising tertiary amine and layer silicate is present in the detergent according to the invention in a quantity of from 5 to 30% by weight, based on the weight of the detergent.

Detergent compositions in accordance with this invention having particularly valuable properties additionally contain at least one water-soluble or water-insoluble quaternary ammonium compound corresponding to the following formula $$R^4R^5R^6R_7N^+A^- \qquad \text{(III)}$$

wherein $R^4$ is a $C_{10}$–$C_{24}$ alkyl or alkenyl group, $R^5$ is equal to $R^4$ or a $C_1$–$C_4$ alkyl or hydroxyalkyl group, $R^6$ is equal to $R^5$ or a $C_1$–$C_4$ alkyl or hydroxyalkyl group, and $A^-$ is an anion establishing electroneutrality, the quantit of quaternary ammonium compound making up preferably from 0.5 to 10% by weight of the detergent composition according to the invention. Detergent compositions additionally containing a quaternary ammonium compound according to this invention are distinguished by further improved softening power and improved detergency. The ditallowalkyl methylamine preferably used is present in the detergent according to the invention in a quantity of preferably from 0.5 to 15% by weight, based on the weight of the detergent. Quantities more than 15% do not improve the softening effect. A noticeable, although slight effect, is obtained with a quantity of only 0.5% by weight, although quantities of more than 0.5% by weight may also be used according to the desired strength of the effect. However, the intensity of the effect depends not only on the amount of amine used but also on the remaining composition of the detergent according to the invention.

In a preferred embodiment, the detergent composition according to this invention contains the fabric softener component comprising the tertiary amine and the layer silicate in the form of an intimate mixture which has been prepared by mixing the molten amine with the powder-form layer silicate in a quantitative weight ratio of from 2:1 to 1:2. Accordingly, the present invention also relates to a fabric softner component comprising (a) a tertiary amine corresponding to formula I, and (b) a layer silicate comprising a fabric incrustation-inhibiting layer silicate containing a smectite-like crystal phase and having the afore-mentioned oxide summation formula II. The addition of a premixed fabric softener component such as this to a detergent composition having a high content of conventional surfactants and builders provides a detergent composition having a pronounced fabric-softening effect and a fabric incrustation-inhibiting effect.

In order to further improve its detergency, the detergent composition may additionally contain a quaternary ammonium compound. Where a compound containing two long $C_{10}$–$C_{24}$ alkyl or alkenyl radicals which may be linear or branched and interrupted by amide, ester or ether groups is used as the quaternary ammonium compound, the detergent is distinguished by a further enhanced softening effect. To improve its detergency, it is of advantage to add lauryl trimethylammonium salt, preferably in a quantity of from 0.5 to 5% by weight, based on the weight of detergent.

The fabric detergent and softening preparation according to this invention may contain as a further component a soil suspending agent which suspends the soil detached from the fabrics in the wash solution and thus prevents their redeposition. Suitable soil suspending agents include water-soluble, generally organic colloids, such as for example water-soluble salts of polymeric carboxylic acids, glue, gelatin, salts of ether carboxylic acids or ether sulfonic acids of starch or cellulose, or salts of acidic sulfuric acid esters of cellulose or starch. Water-soluble polyamides containing acidic groups are also suitable for this purpose. It is also possible to use soluble starch preparations and other starch products than those mentioned above, such as for example degraded starch, aldehyde starches, etc. Polyvinylpyrrolidone may also be used. In many cases, an addition of polyvinylpyrrolidone suppresses the undesired tranfer of dyes which have been detached from intensively dyed fabrics, to less intensively dyed or undyed fabrics.

Among the compounds releasing $H_2O_2$ in water which are used as bleaches, sodium perborate tetrahydrate ($NaBO_2 . H_2O_2 . 3 H_2O$) and the monohydrate ($NaBO_2 . H_2O_2$) are of particular importance. However, other borates which yield $H_2O_2$, for example, perborax ($Na_2B_4O_7 . 4 H_2O_2$), are also suitable. These compounds may be completely or partly replaced by other active oxygen carriers, more especially by peroxypyrophosphates, citrate perhydrates, urea/$H_2O_2$ or melamine/$H_2O_2$ compounds, and by $H_2O_2$-yielding peracidic salts, such as for example, caroates ($KHSO_5$), perbenzoates or peroxyphthalates.

Since the detergent compositions according to this invention are inter alia intended for washing at low washing temperatures, bleach components containing activators are preferably incorporated therein. Certain N-acyl and O-acyl compounds which form organic per-acids serve as activators for per compounds releasing $H_2O_2$ in water. Suitable compounds include, inter alia, N-diacylated and N,N'-tetra-acylated amines such as, for example, N,N',N'-tetra-acetyl methylenediamine and ethylenediamine or tetra-acetyl glycoluril.

The detergent composition may additionally contain optical brighteners, for example for cotton or polyamide fibers.

The detergent composition according to this invention may be prepared both in particulate form, i.e. as generally produced by spray drying, spray cooling or by granulation, and also in liquid or pasty form. Organic solvents, for example lower alcohols, ether alcohols, or ketones containing from 1 to 4 carbon atoms, may be additionally used in the production of liquid or pasty formulations. In many cases, it is best to use highly swellable layer silicates of the smectite type in addition to the described layer silicates having a low swelling power. By the addition of smectites, the softening effect of the detergents according to the invention may be optimized for use at different washing temperatures and with different fabrics.

EXAMPLE I

A finely divided suspension was prepared from an aqueous magnesium sulfate heptahydrate solution and an aqueous sodium silicate ($SiO_2$: $Na_2O$ = 1:3.5) solution by mixing and was then mixed with sodium hydroxide solution, hydrargillite containing 63% by weight $Al_2O_3$, and water. The mixing ratios were selected so that there were 1.4 moles $Na_2O$, 0.05 mole $Al_2O_3$, 1.5 moles $SiO_2$ and 50 moles water to 1 mole MgO. This mixture was heated for 20 minutes to 190° C. in a stirring autoclave and stirred at that temperature for 6.5 hours. After cooling to 100° C., the layer silicate formed was filtered off from the mother liquor and the filter cake washed with water until no more sulfate could be detected in the washing water. A layer silicate having the following oxide composition was obtained after drying at 100° C.

$$MgO . 0.25\ Na_2O . 0.052\ Al_2O_3 . 1.42\ SiO_2 . 1.35\ H_2O$$

EXAMPLE II

Ditallowalkyl methylamine melted by heating was sprayed onto the layer silicate of Example I with agitation of the layer silicate (ratio by weight 1:1). 10% by weight of the amine/layer silicate mixture was added to the following detergent composition so that the detergent composition contained 5% by weight amine and 5% by weight layer silicate:

8.0% by weight Na alkyl benzenesulfonate,
2.4% by weight tallow alcohol+5 moles ethylene oxide,
0.5% by weight tallow alcohol+14 moles ethylene oxide,
1.5% by weight cocosalcohol+4 moles ethylene oxide,
0.8% by weight $C_{16}$–$C_{22}$ fatty acid, Na salt,
25.0% by weight zeolite A,
4.0% by weight polycarboxylate,
5.0% by weight soda ash,
1.5% by weight waterglass,
22.5% by weight Na perborate tetrahydrate,
0.8% by weight MC/CMC, and remainder, Na sulfate.

For comparison, a detergent composition was prepared without layer silicate, but with the same quantity of amine, the proportion of Na sulfate being increased to replace the layer silicate. Test fabrics of cotton terry, molleton and polyester/cotton, which had been prewashed 5 times with a conventional heavy-duty detergent were washed once with each of the aforementioned test detergents in an automatic drum-type washing machine (Siemens Siewamat 570), one-wash cycle at 60° C.; detergent dosage 252 g per 3.5 kg fabrics, hung out to dry in air for 24 hours and then tested for softness by five experienced examiners. Averaged over all the tested fabrics, the fabrics washed with the detergent according to this invention were judged to be distinctly softer than the comparison detergent which only contained amine. The detergent power of both detergents was the same.

What is claimed is:

1. A fabric-softening detergent composition containing a surfactant, a builder, and a fabric softener component consisting essentially of a tertiary amine corresponding to the following formula $$R^1R^2R^3N \quad (I)$$

wherein $R^1$ is a $C_{10}$–$C_{24}$ alkyl or alkenyl group, $R^2$ is the same as $R^1$ or a $C_1$–$C_4$ alkyl group, $R^3$ is a $C_1$–$C_4$ alkyl group, or a mixture of said amines and (b) a layer silicate, said layer silicate consisting essentially of a fabric incrustation-inhibiting synthetic layer silicate having a smectite-like crystal phase and the following oxide summation formula $$MgO.a\ M_2O.b\ Al_2O_3.c\ SiO_2.n\ H_2O \quad (II),$$

wherein

M represents sodium, or sodium together with lithium, with the proviso that the molar ratio of Na to Li is at least 2, and wherein a is equal to about 0.05 to 0.4, b is equal to 0 to about 0.3, c is equal to about 1.2 to about 2.0, and n is equal to about 0.3 to about 3.0, n representing the water bound in the crystal phase.

2. A detergent composition as in claim 1 wherein said tertiary amine and said layer silicate are present in a ratio by weight of from about 3:1 to 1:3.

3. A detergent composition as in claim 1 wherein said fabric softener component consisting essentially of said tertiary amine and said layer silicate is present in a quantity of from about 5 to about 30% by weight, based on the weight of said detergent composition.

4. A detergent composition as in claim 1 including at least one water-soluble water-insoluble quaternary ammonium compound corresponding to the formula $$R^4R^5R^6R^7N^+A^- \quad (III)$$

wherein $R^4$ is a $C_{10}$–$C_{24}$ alkyl or alkenyl group, $R^5$ is equal to $R^4$ or a $C_1$–$C_4$ alkyl hydroxyalkyl group, $R^6$ is equal to $R^5$ or a $C_{1-C4}$ or hydroxyalkyl group, and $A^-$ is an anion establishing electroneutrality, in a quantity of from about 0.5 to about 10% by weight, based on the weight of said detergent composition,

5. A detergent composition as in claim 4 wherein said quaternary ammonium compound comprises a lauryl trimethylammonium salt.

6. A detergent composition as in claim 1 wherein said tertiary amine consists essentially of ditallowalkyl methylamine.

7. A detergent composition as in claim 1 wherein said fabric softener component consisting essentially of tertiary amine and layer silicate has been prepared by thorough mixing of the molten amine with the powder-form layer silicate, in a quantitative weight ratio of from about 2:1 to 2:2.

8. A detergent composition as in claim 1 wherein said layer silicate has the structural formula $$[Na_{x+y}(Mg_{3-x}Li_x)(Si_{4-y}Al_y)O_{10}(OH)_2].m\ [Na_2Si_zO_{2z+1}].n\ H_2O$$

and x is equal to 0 to about 0.3, y is equal to 0 to about 0.5, x+y is equal to about 0.1 to about 0.5, z is equal to about 1 to about 22, m is equal to about 0.1 to about 0.5, and n is equal to 0 to about 8.

9. A detergent composition as in claim 1 wherein $R^1$ and $R^2$ independently of one another are $C_{12}$–$C_{22}$ alkyl groups, and $R^3$ is methyl or ethyl, in said tertiary amine.

10. detergent composition as in claim 1 wherein a is equal to about 0.15 to about 0.30, b is equal to 0 to about 0.10, and c is equal to about 1.3 to about 1.5.

11. A detergent composition as in claim 1 including a soil suspending agent.

12. A detergent composition as in claim 1 including a compound releasing hydrogen peroxide in water.

13. A detergent composition as in claim 1 wherein said surfactant is selected from the group consisting of an anionic, zwitter-ionic, and nonionic surfactant.

14. A detergent composition as in claim 1 wherein said builder is selected from an organic salt and an inorganic salt.

15. A fabric-softening detergent composition containing a surfactant, a builder, and 5 to 30% by weight, based on the weight of said detergent composition, of a fabric softner component consisting essentially of a tertiary amine corresponding to the following formula $$R^1R^2R^3N \quad (I)$$

wherein $R^1$ is a $C_{10}$–$C_{24}$ alkyl or alkenyl group, $R^2$ is the same as $R^1$ or a $C_1$–$C_4$ alkyl group, $R^3$ is a $C_1$–$C_4$ alkyl group, or a mixture of said amines and (b) a layer silicate, said layer silicate consisting essentially of a fabric incrustation-inhibiting synthetic layer silicate having a smectite-like crystal phase and the following oxide summation formula $$MgO.a\ M_2O.b\ Al_2O_3.c\ SiO_2.n\ H_2O \quad (II)$$

wherein

M represents sodium, or sodium together with lithium, with the proviso that the molar ratio of Na to Li is at least 2, and wherein a is equal to about 0.05 to about 0.4, b is equal to 0 to about 0.3, c is equal to about 1.2 to about 2.0, and n is equal to about 0.3 to about 3.0, n representing the water bound in the crystal phase.

16. A detergent composition as in claim 15 wherein said tertiary amine and said layer silicate are present in a ratio by weight of from about 3:1 to 1:3.

17. A detergent composition as in claim 15 including at least one water-soluble or water-insoluble quaternary ammonium compound corresponding to the formula $$R^4R^5R^6R^7N^+A^- \quad (III)$$

wherein $R^4$ is a $C_{10}$–$C_{24}$ alkenyl group, $R^5$ is equal to $R^4$ or a $C_1$–$C_4$ or hydroxyalkyl group, $R^6$ is equal to $R^5$ or a $C_1$–$C_4$ or hydroxyalkyl group, and $A^-$ is an anion establishing electroneutrality, in a quantity of from about 0.5 to about 10% by weight, based on the weight of said detergent composition.

18. A fabric softener component for a detergent composition, said component consisting essentially of a tertiary amine corresponding to the following formula $$R^1R^2R^3N \quad (I)$$

wherein $R^1$ is a $C_{10}$–$C_{24}$ alkenyl group, $R^2$ is the same as $R^1$ or a $C_1$–$C_4$ alkyl group, $R^3$ is a $C_1$–$C_4$ alkyl group or a mixture of said amines and (b) a layer silicate, said layer silicate consisting essentially of a fabric incrustation-inhibiting synthetic layer silicate having a smectite-like crystal phase and the following oxide summation formula $$MgO.a\ M_2O.b\ Al_2O_3.c\ SiO_2.n\ H_2O \quad (II).$$

wherein

M represents sodium, or sodium together with lithium, with the proviso that the molar ratio of Na to Li is at least 2, and wherein a is equal to about 0.05 to about 0.4, b is equal to 0 to about 0.3, c is equal to about 1.2 to about 2.0, and n is equal to about 0.3 to about 3.0, n representing the water bound in the crystal phase.

19. A fabric softener component as in claim 18 wherein said tertiary amine and said layer silicate are present in a ratio by weight of from about 3:1 to 1:3.

20. A fabric softener component as in claim 18 prepared by mixing the molten amine with the layer silicate.

* * * * *

UNITED STATES PATENT AND TRADEMARK OFFICE

CERTIFICATE OF CORRECTION

PATENT NO. : 4,846,990

DATED : July 11, 1989

INVENTOR(S) : Horst Upadek and Winfried Wichelhaus

It is certified that error appears in the above-identified patent and that said Letters Patent is hereby corrected as shown below:

In Claim 17, at Col. 10, line 67, after "$C_{10}$-$C_{24}$" should read --alkyl or--.

In Claim 17, at Col. 10, line 68, after "$C_1$-$C_4$" should read --alkyl --.

In Claim 17, at Col. 11, line 1, after "$C_1$-$C_4$" should read --alkyl --.

In Claim 18, at Col. 11, line 15, after "$C_{10}$-$C_{24}$" should read --alkyl or--.

Signed and Sealed this

Twenty-fourth Day of April, 1990

*Attest:*

HARRY F. MANBECK, JR.

*Attesting Officer*

*Commissioner of Patents and Trademarks*